US005082068A

United States Patent [19]

Cornell

[11] Patent Number: 5,082,068

[45] Date of Patent: Jan. 21, 1992

[54] DRILLING MACHINE FOR DRILLING HOLES IN ROCKS

[75] Inventor: Ron A. Cornell, Hastings, N.Y.

[73] Assignee: Syracuse Utilities, Inc., Brewerton, N.Y.

[21] Appl. No.: 491,544

[22] Filed: Feb. 23, 1990

[51] Int. Cl.[5] ..... E21B 7/02

[52] U.S. Cl. ..... 173/22; 173/28; 173/39

[58] Field of Search ..... 173/22, 28, 163, 164, 173/39, 43, 104

[56] References Cited

U.S. PATENT DOCUMENTS

| | | | |
|---|---|---|---|
| 3,431,983 | 3/1969 | Jacobson | 173/22 X |
| 4,134,460 | 1/1979 | Klemm | 173/104 X |
| 4,351,625 | 9/1982 | Selestan et al. | 173/22 X |
| 4,889,192 | 12/1987 | Ricard | 173/22 |
| 4,938,296 | 7/1990 | Brazell, II | 173/22 |

OTHER PUBLICATIONS

Buckeye Drill Company 2400 R (Brochure) GEMCO (Brochure).
Transquipment, Inc. (Brochure).
Buckeye Drill Company Water Well Drills (Brochure).
Gemco PS-750 (Brochure).

*Primary Examiner*—Timothy V. Eley
*Assistant Examiner*—Willmon Fridie, Jr.
*Attorney, Agent, or Firm*—Kane, Dalsimer, Sullivan, Kurucz, Levy, Eisele and Richard

[57] ABSTRACT

A truck-mounted rock drilling machine for pole holes consists of a pivotable boom mounted on the truck bed and a jack-hammer-like mechanism mounted on the boom. The jack hammer like mechanism is driven from a compressor which is preferably mounted on a separate trailer.

11 Claims, 7 Drawing Sheets

FIG. 4
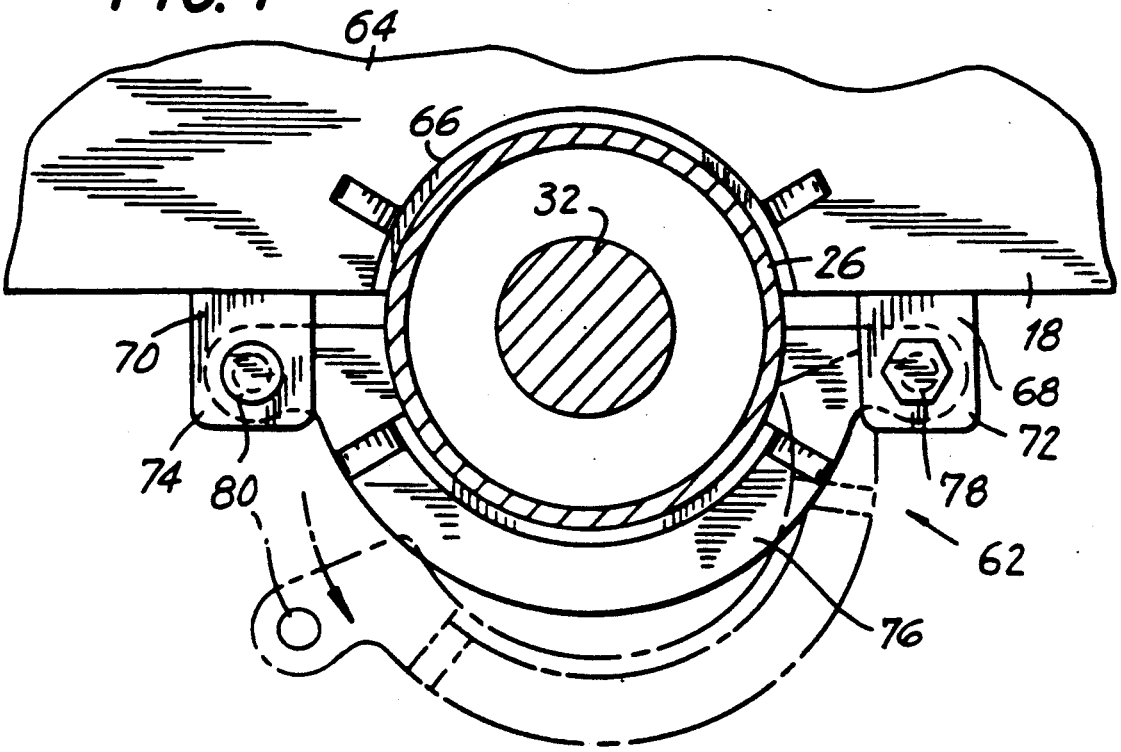
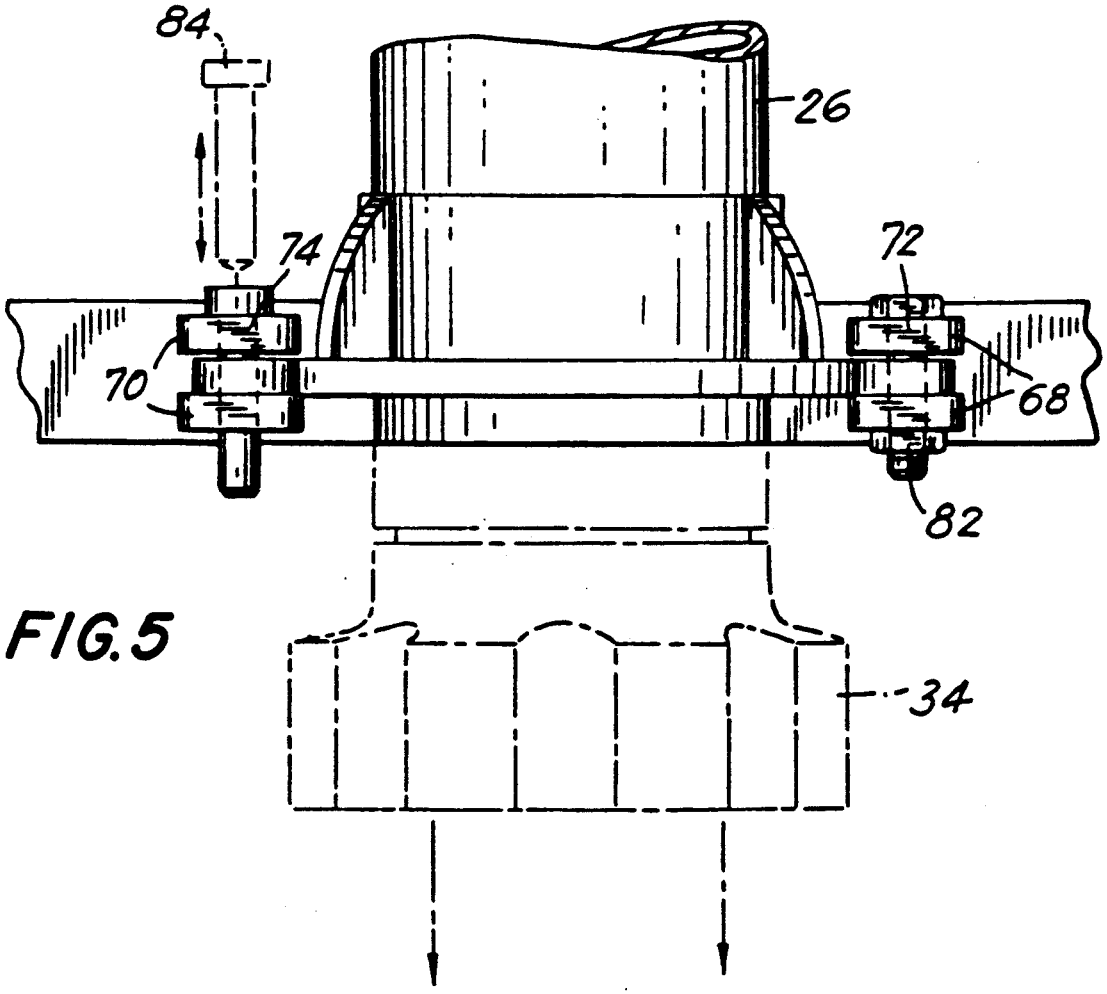
FIG. 5

FIG. 7
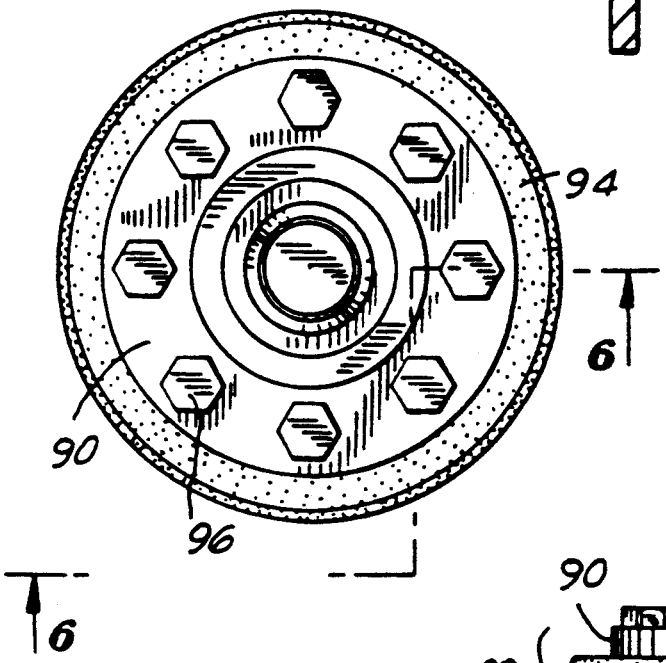
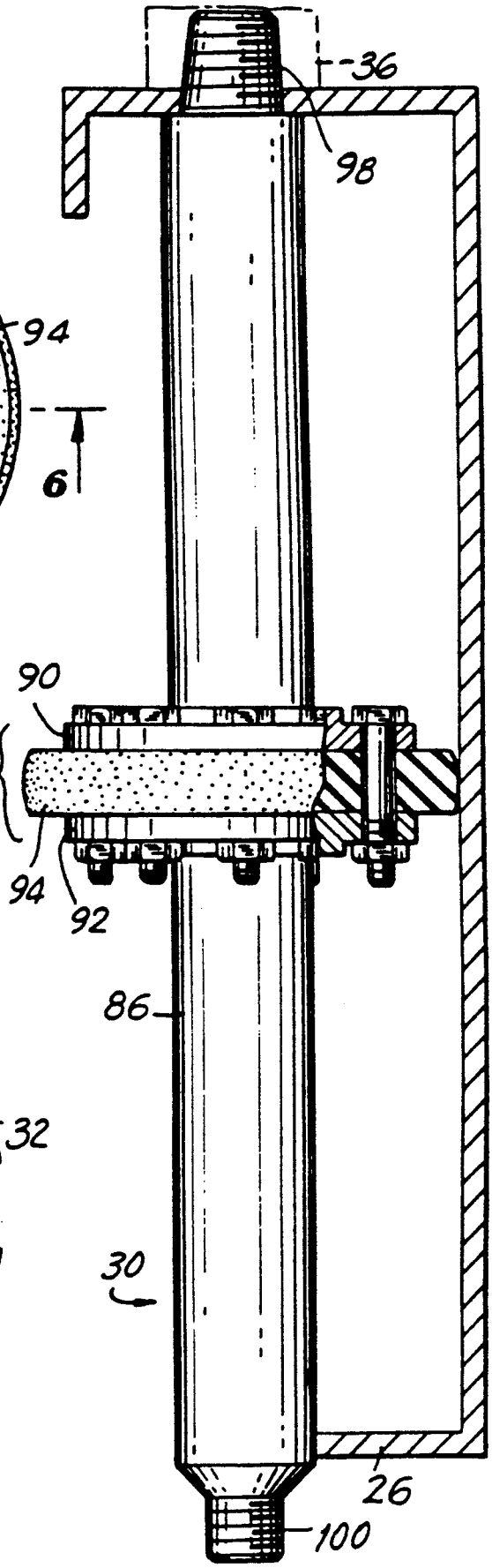
FIG. 6
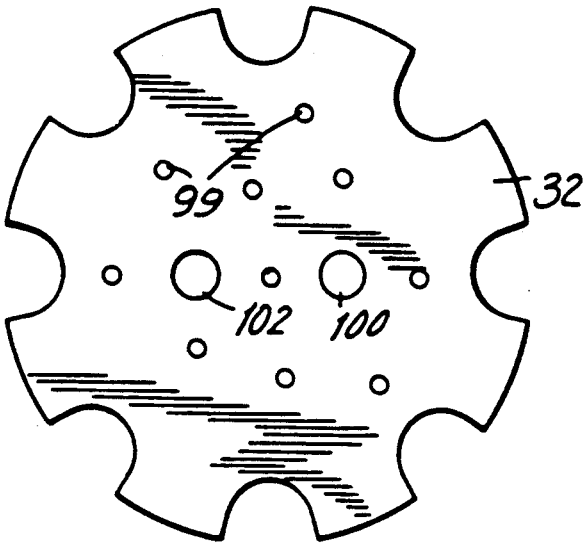
FIG. 8

O
122
124
10
10
108
110
126
106
112
18
104
128
120
118
130
132
11
114
11
16

FIG. 10
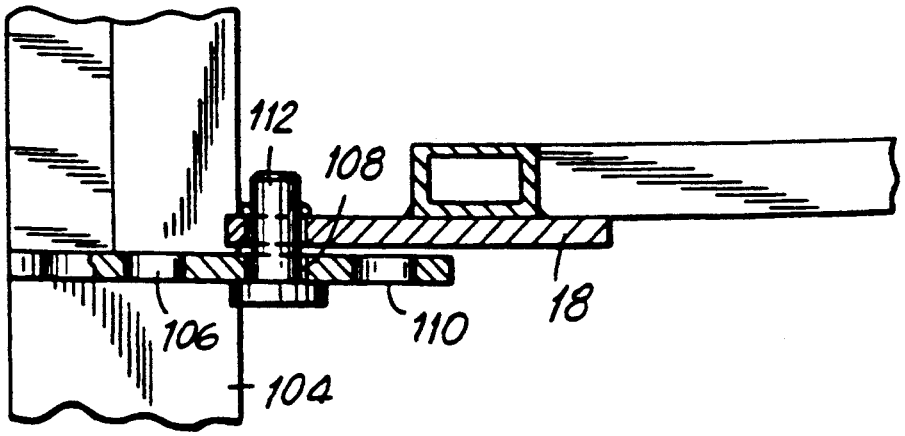
FIG. 11
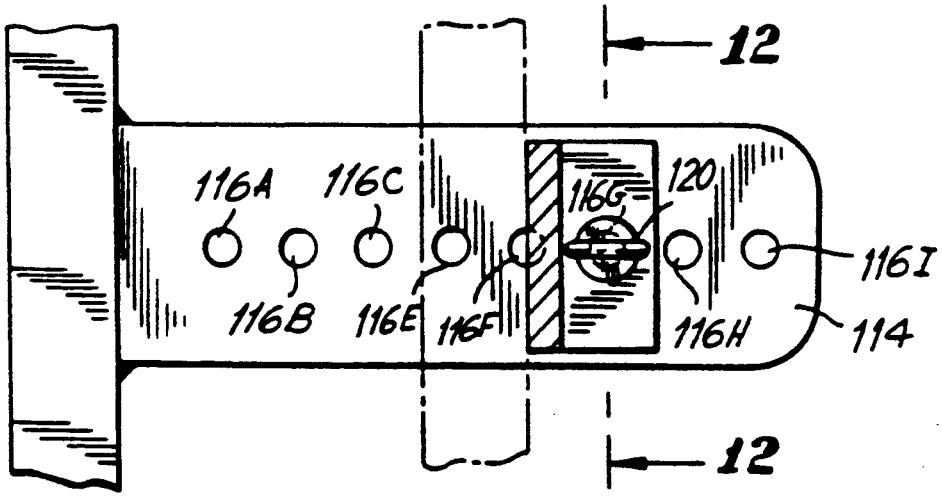
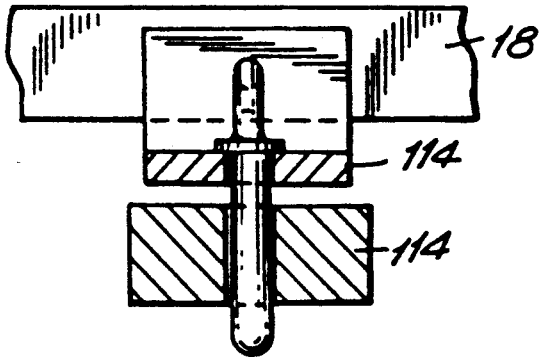
FIG. 12

DRILLING MACHINE FOR DRILLING HOLES IN ROCKS

BACKGROUND OF THE INVENTION a. Field of Invention

This invention pertains to a machine for drilling holes in rocks, and more particularly, for drilling relatively wide, yet shallow, holes suited for installation of utility poles, street lighting, guard railing, highway sound barriers, etc.

b. Description of the Prior Art

Utility poles are widely used for stringing various cables and wires in open country, which cables carry electric power, telephone signals and so forth. Several poles must be positioned in straight lines along preselected routes and rights-of-way, at preselected positions and spacings dependent on the weight of the cables, weather conditions in the area, etc. Thus, the pole positions are not dictated by, and in most instances cannot be changed to suit, local geological conditions. Thus, if soil at a particular pole position consists of a mass of rock, a hole must be dug in the rock for the pole. Until now, such holes could be made by either core drilling or blasting. Core drilling is very slow. A hole in a typical rock mass may take up to half-a-day. Blasting is quicker, but also very dangerous resulting in irregular holes which must be shaped by filler material, such as cementor run a crush, before they can be used for positioning poles.

Other equipment is available for digging holes in rock for other purposes. For example, the Buckeye Drill Company of South Milwaukee, Wis., makes a rotary drill machine Model No, 2400-R which can be used to make holes of 6–30 inches in diameter to a depth of 2500 feet for oil or water. However, this equipment weighs 61,000 pounds and, therefore, is difficult to transport to remote locations, especially if no roads are found nearby. Furthermore, this equipment is expensive to buy and to operate.

Another available machine is from Gemco Equipment Co., Houston, Tex., which is used for geological and seismographic surveys. However, this machine is capable of making only 4 inch holes. Furthermore, this machine is not only extremely heavy, but also large and cumbersome, so that it is not well suited for transportation through narrow areas or embankments.

Thus, there exists a need for a special type drilling machine for making holes in rocks for utility poles, street lighting, guard railing, highway sound barrier, etc.

OBJECTIVES AND SUMMARY OF THE INVENTION

In view of the aforementioned disadvantages of the prior art, it is an objective of the present invention to provide a rock drilling machine for drilling holes for planting utility poles which machine is small and light enough for transportation on restricted terrain.

A further objective is to provide a machine which can be set up easily and expediently with minimum amount of labor.

Yet another objective is to provide a machine which can be mounted in a truck and can be adjusted in the operational position to compensate for variations in the terrain grade.

Other objectives and advantages of the invention shall become apparent form the following description of the invention. Briefly, a rock drilling machine for making holes for utility poles consists of a boom mounted on the back of a truck and hydraulically pivotable between a horizontal and a vertical position. The boom holds a rotatable hammer, and means for driving the hammer. The machine also includes vertical adjusting means for adjusting the position of the hammer vertically and transversal adjusting means for adjusting the position of the machine in a direction transversal to its longitudinal axis. The two adjusting means cooperate to compensate for the variations of the terrain in the vicinity of the prospective hole.

Preferably a separate compressor pump is provided on its own trailer which provides hydraulic and pneumatic power for the boom and its auxiliary equipment.

BRIEF DESCRIPTION OF THE FIGURES

FIG. 4 shows a partial plan view of the hammer;

FIG. 5 shows a sectional view of the hammer in FIG. 4;

FIG. 6 shows an elevational view of the hammer of FIGS. 1–5;

FIG. 7 shows a plan-sectional view of the hammer of FIG. 6 and its support;

FIG. 8 shows a bottom view of hammer of FIGS. 6 and 7;

FIGS. 10, 11 and 12 show sectional plan views taken along lines 10—10, 11—11 and 12—12 respectively in FIG. 10.

DETAILED DESCRIPTION OF THE INVENTION

Figure 1:
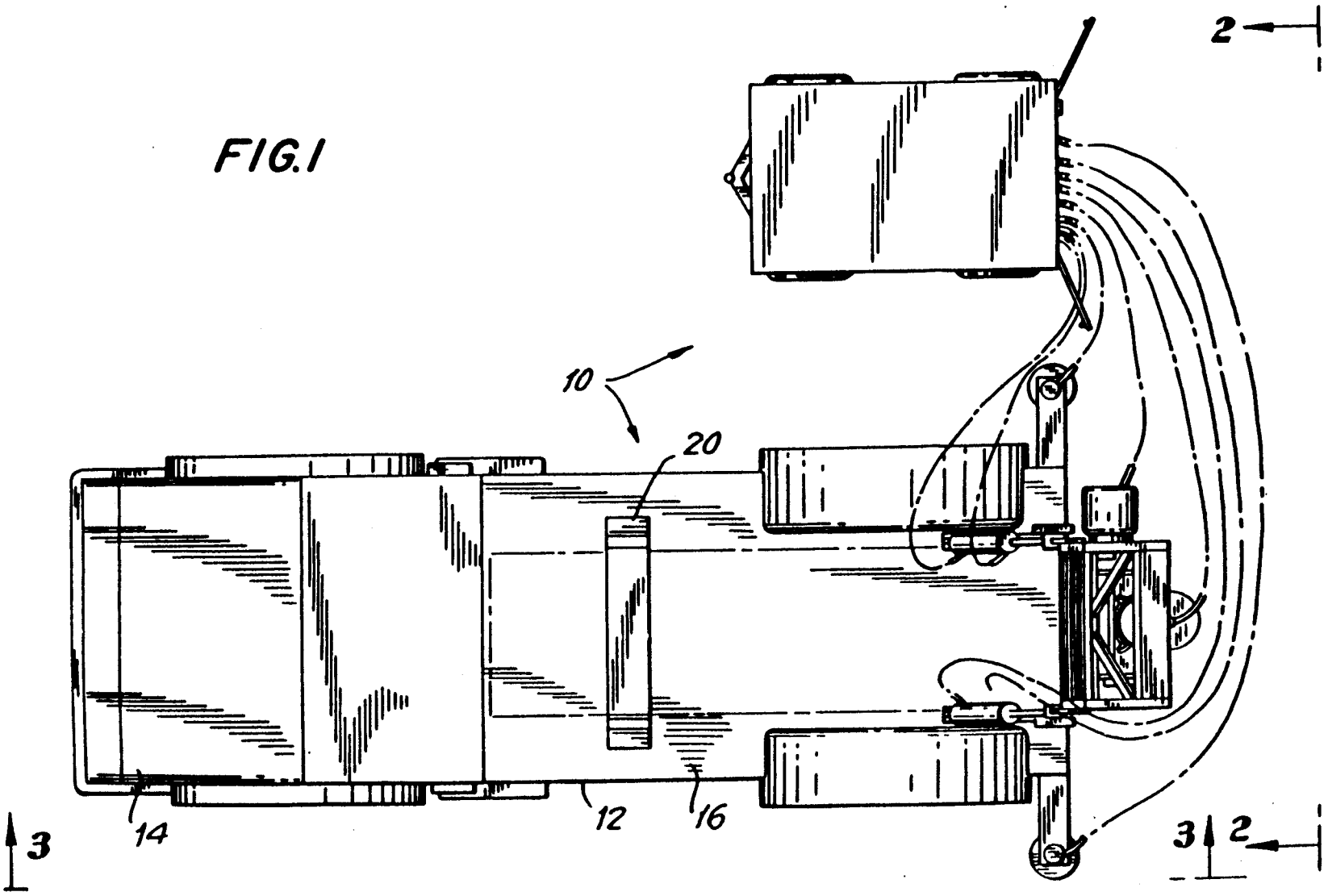
FIG. 1 shows a plan view of a rock drilling machine constructed in accordance with this invention.

Referring now to the Figures, a rock drilling machine 10 constructed in accordance with this invention consists of a truck 12 with a cab 14, and a truck bed 16 for transporting a boom 18. On the truck bed 16 there is a support beam 20 for holding the boom 18 when the boom is in its horizontal position indicated by dashed lines 18'. Because the boom is smaller than the prior art rock drilling booms it can be mounted on a standard truck with standard truck tires 22 so that the truck 12 can go on normal roads as well as on rough and steep terrain with relative ease.

Figure 2:
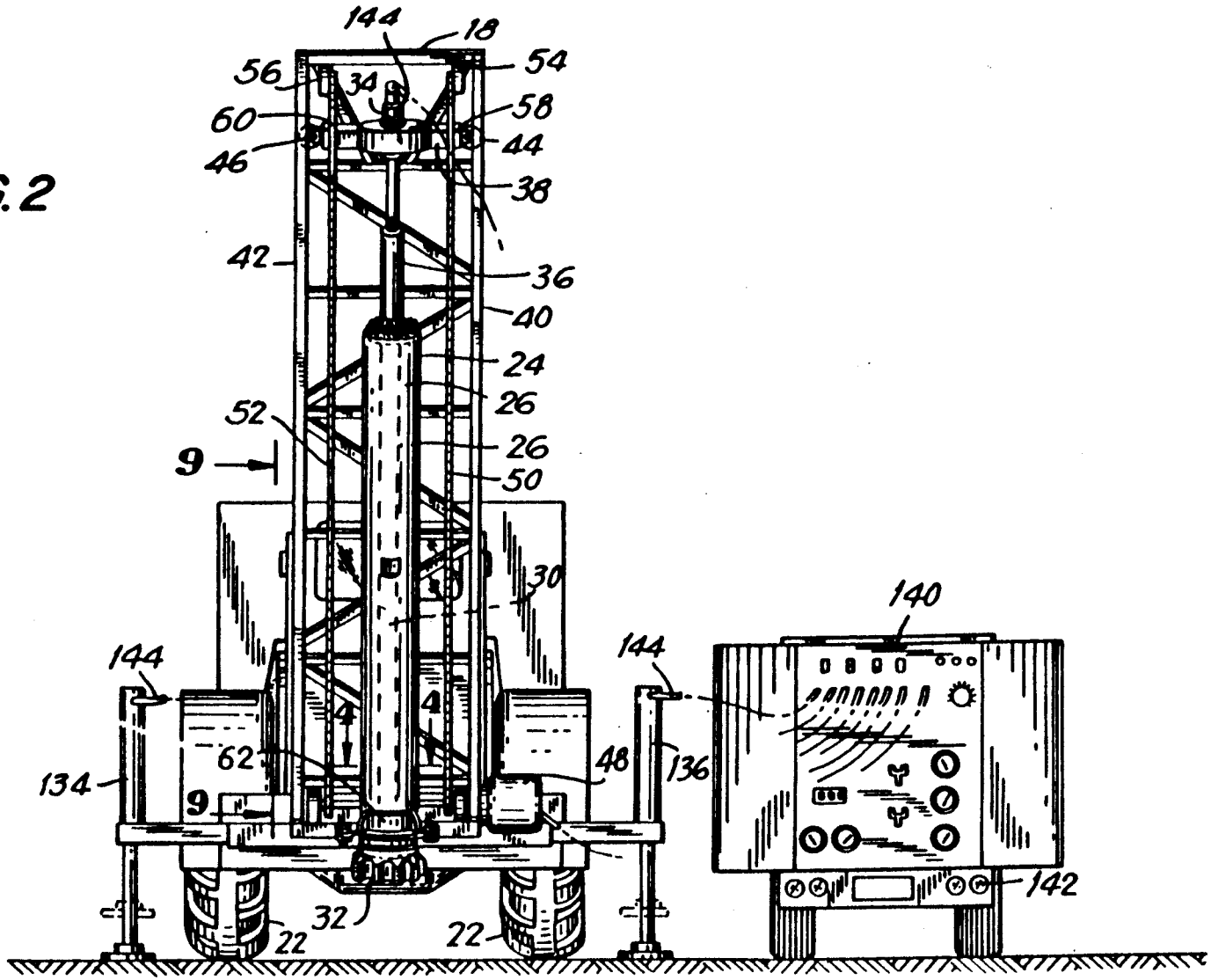
FIG. 2 shows an end view of the machine of FIG. 1.
Figure 3:
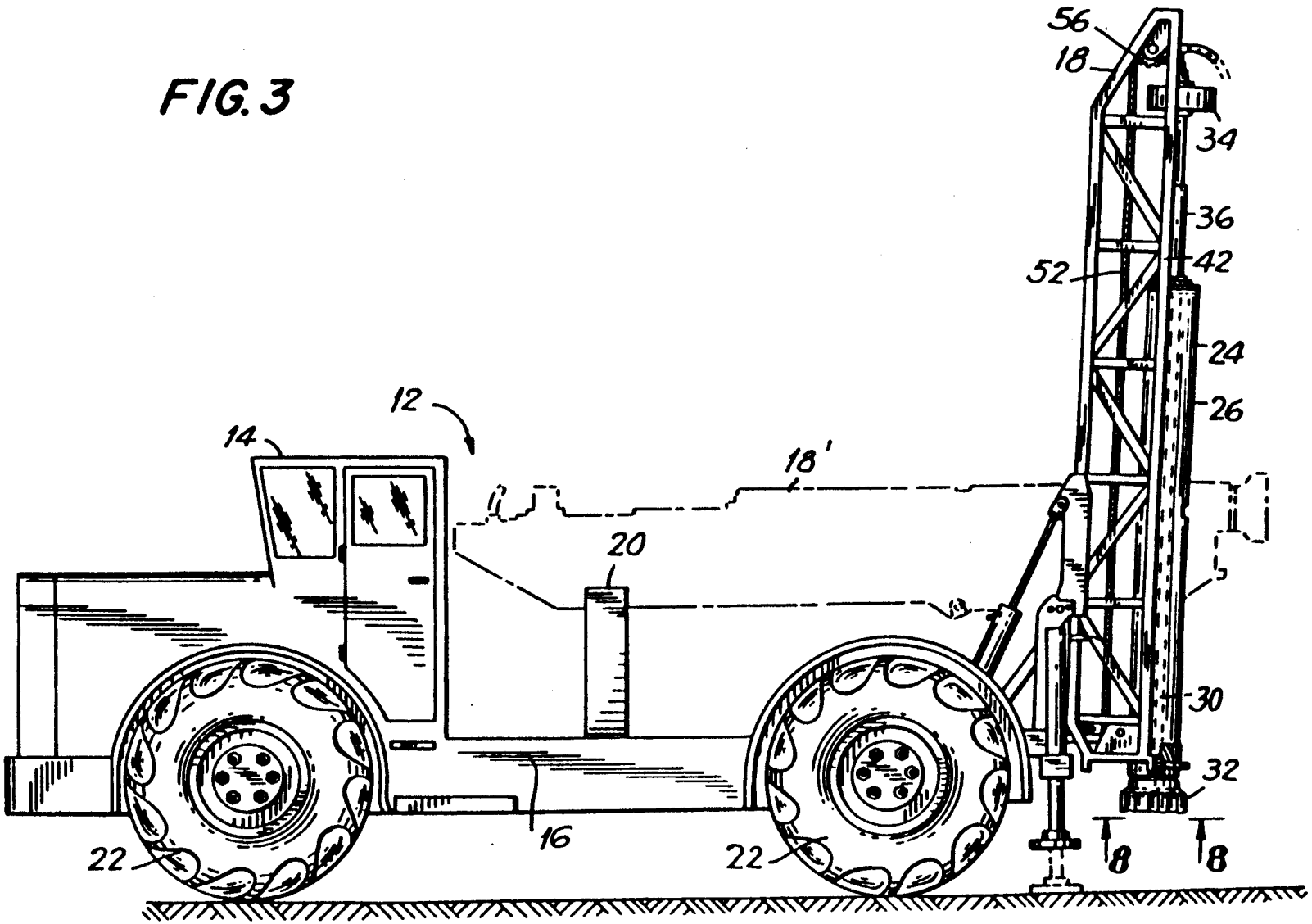
FIG. 3 shows a side view of the machine of FIGS. 1 and 2.
Figure 9:
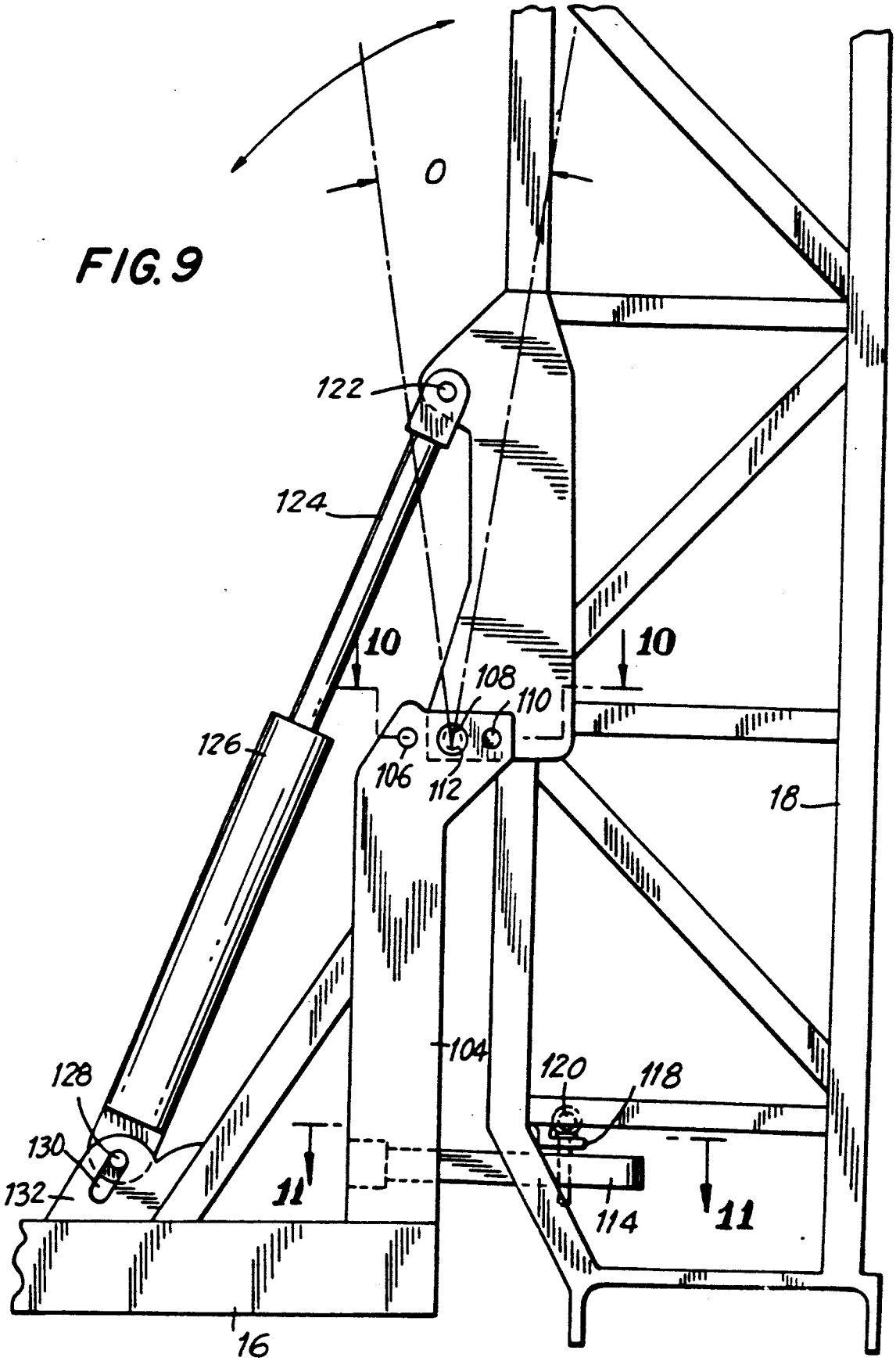
FIG. 9 shows a side-sectional view of the mechanism used to pivot the boom of FIG. 1.

The frame 18 carries a hammer 24 consisting of an elongated protective sleeve 26. Within the sleeve 28 there is an impact drill 30 terminating in a star-shaped head 32 disposed outside sleeve 28. The hammer also includes a hammer drive 34 connected to the drill 30 by extension 36. As seen more clearly in FIG. 2, the hammer drive 34 is secured to a carriage 38 which rides between two rails 40, 42 of frame 18 on two corresponding wheels 44, 46.

Disposed on the bottom of the frame 18 is a hydraulic drive 48 used to turn two lower sprocket wheels (not shown) engaging two endless chains 50, 52. At the top of the frame 18 the chains 50, 52 are trained around upper sprocket wheels 54, 56. Carriage 38 is secured to chains 50, 52 as at 58, 60 so that the hammer 24 can be moved up or down by the activation of pneumatic drive 48.

The bottom of frame 18 also includes a guide 62 for guiding the vertical reciprocating movement of the hammer sleeve 26. As shown more clearly in FIGS. 4 and 5 the frame 18 includes a bottom plate 64 with a semicircular wall 66. Two pairs of extensions 68, 70 protrude from the wall 64 offset vertically as shown. Each set of extensions also has throughholes 72, 74. The guide also includes a movable member 76 having a generally semicircular shape and having two ends with througholes 78, 80. The member 76 is pivotally secured at one end to extension 68 by a screw-and-nut combination 82. At the other end there is provided a pin 84. When the member 76 is closed by pin 84, it forms a circular guide for sleeve 26. When pin 84 is removed the member 76 may be moved away from the frame 18 to permit servicing and/or replacement of hammer 24. In operation, guide 62 maintains the movement of the hammer and also insures that the hammer does not "walk" as it is drilling the rock.

As shown in FIGS. 6 and 7, hammer drill 30 includes a shaft 86 mounted within sleeve 26. On shaft 26 there is a bushing assembly 88 to maintain shaft 86 at the center of the sleeve 26. Bushing assembly 88 includes an upper steel plate 90, a lower steel plate 92, and a rubber disk 94 sandwiched in between. The bushing assembly 88 is held together with a plurality of screw-and-nut combinations 96 The two ends of the shaft 86 are threaded as at 98 and 100 so that the shaft 86 can be connected respectively to extension 36 and head 32, with an intermediate coupler (not shown) being provided for head 32. As shown in FIG. 8, head 32 may include two holes 100, 102 to release air or water respectively to facilitate the removal of the rock pulverized by head 32. The bottom surface of drill head 32 is provided with a plurality of carbide bits 99 to facilitate the drilling operation.

As shown in FIGS. 9–12, the vertical position of the frame 18 is determined by three pins (actually the machine is provided with six pins with half of them being visible in the Figures). Truck bed 16 includes an upright member 104 terminating in three holes 106, 108 and 110 disposed along a substantially horizontal plane. A pin 112 (disposed in hole 108 in the Figures) secures the frame 18 to upright 104 through a corresponding hole (not shown) in the frame 18. Truck 16 further includes a horizontal extension 114 with a plurality of holes 116A-I. Frame 16 also has a corresponding lip 118 with a hole (not shown) and a pin 120 is passing through lip 118 to secure it to extension 114 via one of the holes 116. (More particularly hole 116G as shown in FIG. 11) Finally, above upright 104, frame 18 has another hole for engaging through a pin 122 the arm 124 of a hydraulic cylinder 126. The end opposite arm 124, cylinder 126, has a pin 128 disposed in a diagonal slot 130 of a vertical Wall 132. Vertical wall 132 is secured to truck 16.

The arrangement in FIGS. 9–12 is used to position the frame 18 vertically. Initially, as previously mentioned, the frame extends vertically along the truck 16. In this position, arm 124 is disposed substantially within cylinder 126 and pin 120 is not installed. After the truck is positioned at the desired location, cylinder 126 is activated forcing arm 124 to extend thereby rotating frame 9 clockwise around pin 112 until it reaches a substantially vertical position. Once the frame is vertical, pin 120 is installed to maintain the frame in its position. Because of the large number of holes 116 provided, the frame may be fixed in a wide range of positions defined by angle O in FIG. 9, along a vertical plane parallel to the longitudinal axis of truck 14. If this range must be increased even more, pin 112 may be removed from hole 108 and replaced in either hole 106 or 110 as required. Thus, the combination of holes 106, 108, 110 and 116 provide a versatile means of adjusting the vertical angle of the frame. While the frame is moved, pin 128 shifts within the slot 130.

Referring back to FIG. 2, the machine 10 is also provided with two hydraulic outriggers 134, 136. These outriggers are used to align frame 18 vertically in a vertical plane substantially transversal to the longitudinal axis of the truck 12.

The machine 10 is also provided with a compressor which provides air for the various hydraulic and pneumatic devices described above. While the compressor may be mounted on the truck 12, this may make the truck too heavy and difficult to maneuver. Therefore, in a preferred embodiment of the invention a compressor 140 is provided which is disposed on its own trailer 142. This way the truck and trailer may be moved separately to make it easily maneuverable. The compressor sized to provide the preper air pressure volume (typically about 750 cubic feet per minute) for the hammer, and is connected to the various drives by pneumatic tubes 144. For example, the tube connected to drive 44 is used to operate the hammer 24 to simultaneously reciprocate and rotate the drill head 32 to drill a hole, much like a jack hammer. The speed of rotation of the head is controlled by the operator. For a hard rock such as granite, the head is rotated at no more than 11 rpm. For softer rocks up to 20 rpm or more may be used. Preferably, the drilling is stopped at regular intervals and a rock drill oil is applied to the head. At the same time, powered from another tube 144, the force of pneumatic drive 48 is used through the chains 50, 52 to apply a downward pressure on hammer 24. Air from compressor 140 is also blown through a channel within sleeve 26 and out of holes 100, 102 on hammer head 32 to remove rock particles from the under the head. The hammer head 24 and associate equipment may weigh typically about 3000 lbs. contributing to the speed at which holes can be drilled.

The described machine is easily maneuverable in tight places and once it is positioned it can be set up in three minutes. It was found that a 5 foot deep 17½ inch hole could be drilled in pink granite in 45 minutes. The machine may be used to drill holes for street lights, road sign poles, telephone poles, service line poles and so on.

Obviously, numerous modifications can be made to this invention without departing from its scope as defined in the appended claims.

What is claimed is:

1. A rock drilling machine for making pole holes comprising:

a. a truck with wheels for movement on a terrain, and a truck bed of a desired length;

b. a boom pivotally mounted on said truck bed;

c. a pneumatically operated jack hammer means mounted on said boom and including a hammer head for making a hole in the terrain when said boom is pivoted to a vertical position;

d. boom positioning means for positioning the boom in several or more positions with respect to said truck bed and lateral positioning means for positioning said boom laterally with respect to a longitudinal axis along the length of said truck bed; and e. wherein said boom positioning means and lateral positioning means allow for the boom to be pivoted and maneuvered in a range of positions both vertically and laterally.

2. The machine of claim 1 wherein said boom positioning means includes cylinder means for pivoting said boom form a horizontal to said vertical position, and lateral positioning means for positioning said boom laterally with respect to a longitudinal axis of said truck.

3. The machine of claim 1 further including a separate trailer from said truck and compressor mounted on said separate trailer for driving said jack hammer means.

4. A rock drilling machine for making pole holes comprising:

a. a truck with wheels for movement on a terrain, and a truck bed of a desired length;

b. outrigger means coupled to the truck to position the truck along a vertical plane perpendicular to a longitudinal axis along the length of said truck bed;

c. a boom having a boom top and a boom bottom, said boom being pivotally mounted on said truck bed at said boom bottom;

d. boom raising means for pivoting said boom between a substantially horizontal position and a plurality of vertical positions;

e. lateral positioning means for positioning said boom laterally with respect to a longitudinal axis along the length of said truck bed;

f. jack hammer means disposed on said boom, said jack hammer means including a hammer head for making holes;

g. drive means for driving said jack hammer means and for simultaneously reciprocating and rotating said hammer head for drilling said holes; and h. wherein said boom raising means and said lateral positioning means allow for the boom to be pivoted and maneuvered in a range of positions both vertically and laterally.

5. The machine of claim 4 further comprising trailer means separate from said truck and drive means for driving said jack hammer means disposed on said trailer means.

6. The machine of claim 5 wherein said jack hammer is a pneumatic device and said drive means is a compressor.

7. A rock drilling machine for making pole holes comprising:

a. a truck with wheels for movement on a terrain, and a truck bed of a desired length;

b. outrigger means coupled to the truck to position the truck along a vertical plane perpendicular to a longitudinal axis along the length of said truck bed;

c. a boom having a boom top and a boom bottom, said boom being pivotally mounted on said truck bed at said boom bottom;

d. boom raising means for pivoting said boom between a substantially horizontal position and a substantially vertical position;

e. lateral positioning means for positioning said boom laterally with respect to a longitudinal axis along the length of said truck bed;

f. jack hammer means disposed on said boom, said jack hammer means including a hammer head for making holes and a sleeve extending along said boom, a jack hammer drive disposed on said boom and a shaft extending through said sleeve and connecting said hammer head to said hammer drive;

g. drive means for driving said jack hammer means and for simultaneously reciprocating and rotating said hammer head for drilling said holes.

8. The machine of claim 7 wherein said jack hammer means reciprocates said hammer when said boom is in a substantially vertical position.

9. The machine of claim 7 wherein said boom includes sleeve guide means for guiding the movement of said sleeve.

10. The machine of claim 4 wherein said boom raising means includes a hydraulic cylinder assembly coupled between said truck bed and said boom.

11. The machine of claim 10 further including vertical adjustment means for adjusting the vertical position of the boom in a plane parallel to the longitudinal axis of the truck.

* * * * *